US006070545A

United States Patent [19]

Keenan

[11] Patent Number: 6,070,545

[45] Date of Patent: Jun. 6, 2000

[54] SAILS FOR SAILBOATS HAVING SELF-TACKING LEECH FLAPS

[76] Inventor: Paul B. Keenan, 5284 Clymer Rd., Quakertown, Pa. 18951

[21] Appl. No.: 09/223,969

[22] Filed: Dec. 31, 1998

Related U.S. Application Data

[60] Provisional application No. 60/103,533, Oct. 8, 1998.

[51] Int. Cl.[7] ..... B63H 9/04

[52] U.S. Cl. ..... 114/102.13; 114/39.31

[58] Field of Search ..... 114/102.12, 102.13, 114/102.16, 102.22, 102.32, 102.33, 39.29, 39.31

[56] References Cited

U.S. PATENT DOCUMENTS

| | | | |
|---|---|---|---|
| 4,655,122 | 4/1987 | McCabe | 454/259 |
| 5,271,349 | 12/1993 | Magrini | 114/102.33 |
| 5,599,172 | 2/1997 | McCabe | 417/334 |

FOREIGN PATENT DOCUMENTS

| | | |
|---|---|---|
| 2552393 | 3/1985 | France . |
| 413588 | 6/1924 | Germany . |
| 2231854 | 11/1990 | United Kingdom . |

OTHER PUBLICATIONS

McCabe, "McCabe Airfoil Design . . . " Levr/Air Technical Data 1983–1998.

Marchaj, C.A., *Sail Performance,* McGraw–Hill 1990, p. 43–111.

Whidden, Tom, *The Art and Science of Sails,* St. Martin's 1990 p. 72–94, 195.

Garrett, Ross, *The Symmetry of Sailing,* Adlard Coles 1995 pp. 83–87.

Ross, Wallace, *Sail Power,* Alfred A. Knopf, Inc. 1975, pp. 90–100.

Smith, Carroll, *Engineer to Win,* Motorbooks, Int'l 1984, p. 241.

*Primary Examiner*—S. Joseph Morano
*Assistant Examiner*—Andrew D. Wright
*Attorney, Agent, or Firm*—Michael de Angeli

[57] ABSTRACT

In an improved sail for a sailboat, the trailing edges of a pair of flaps of a conventional sail material are attached to the trailing edge of the sail, one on each side; the leading edges of the flaps are not fixed to the sail, but are connected to one another by short sections of line extending through holes in the sail. When the boat is tacked from one tack to the other, the leading edge of the flap on the new windward side is pulled away from the surface of the sail by the wind, so that a flow-impeding lip is provided on the windward side of the leech. At the same time, the lines pull the leeward flap against the main body of the sail, so that drag is not increased substantially. Substantial improvements in sailing performance are realized, while no control action is required to cause the flaps thus to be reconfigured upon tacking, and so that ordinary sailing manuevers and all normal sail handling operations may be carried out without complication.

11 Claims, 4 Drawing Sheets

TRUE W
(a)
(b)
(c)
10
12
13
14
14a
14b
14c
14d
14e
14f
14g
16
16a
16b
16c
16d
16e
16f
16g
18
20
22
30
32
34
36
38

HEADSTAY
H
Sm
H = STREAMLINE THROUGH HEADSTAY
Sm = MAIN STAGNATION STREAMLINE

Sm 14
16

72
70
70a 74
74a 76
76a
76b
78
80

SAILS FOR SAILBOATS HAVING SELF-TACKING LEECH FLAPS

CROSS-REFERENCE TO RELATED APPLICATION

This application claims priority from Provisional Patent Application Ser. No. 60/103,533, filed Oct. 8, 1998.

FIELD OF THE INVENTION

This invention relates to improvements in sails for sailboats. More particularly, the invention relates to providing improved sails for sailboats having increased aerodynamic lift, while not significantly increasing the cost or complexity of use of such sails.

BACKGROUND OF THE INVENTION

The fabrication of efficient sails for sailboats, that is, providing sails which are capable of being controlled to provide sufficient aerodynamic "lift" to allow the boat to sail to windward, while being conveniently handled in use and stowed when not in use, is relatively complex. In order to be useful by the vast majority of sailors, sails must be made of lightweight flexible membranes of various natural and synthetic, woven and composite "sailcloth" materials, so that the sails can be folded, rolled, carried by hand, and stored in relatively small bags, while the sails must also be capable of being shaped by relatively simple control mechanisms to assume efficient aerodynamic shapes varying with wind conditions and the boat's course relative to the wind.

More particularly, in order to make effective progress to windward, that is, towards the source of the prevailing wind, a sail for a sailboat must provide aerodynamic lift, such that a resultant force is exerted on the hull of the boat in a direction less than 90° to the wind. Modern sailing rigs allow properly sailed boats to make progress at 30–45° with respect to the apparent wind, i.e., to the wind as measured on the boat itself; normally this translates to progress at approximately 45° to the "true" wind. Accordingly, in order to make upwind progress, sailboats must "tack", that is, travel in a zig-zag path, alternately at ±45° to the direction of the true wind. The requirement of tacking in turn necessitates that the airfoils provided by the sails be readily reconfigurable in either orientation with respect to the wind, that is, so as to be readily reconfigured to provide efficiently-shaped airfoils for upwind sailing on either tack.

For this reason, and others to be discussed below, the lessons found in such diverse fields as airplane and race car aerodynamics, while instructive, cannot be directly applied to sailboat sails. More particularly, airplane and race car wings provide lift according to the same laws of physics as do sailboat sails. However, airplane and race car wings are invariably two-dimensional in cross-section, i.e., have rigid upper and lower surfaces spaced from one another by some distance; sailboat sails (with a very few exceptions mentioned below), are essentially membranes, comprising a single flexible member supported by more or less rigid spars, to take a desired shape when exposed to the wind.

Further, as mentioned above, sailboats must be able to provide maximum lift to windward while on either tack, i.e., regardless which side of the membrane faces the direction of the wind. Therefore, as a sailboat tacks to go to windward, its sails must be readily reconfigurable between mirror-imaged airfoil shapes, as the opposite surfaces of the sails alternatingly become the windward and leeward surfaces.

By comparison, an airplane wing need provide maximum lift only while taking off. In that case, the wing is always oriented in the same direction, and may accordingly be asymmetric in cross-section. Stated differently, while an inverted airplane wing may provide sufficient lift to allow the airplane to fly upside down, under no circumstances need the inverted wing provide sufficient lift to allow the airplane to take off. Similarly, modern racing cars use inverted wings to provide additional aerodynamic "downforce", i.e., lift directed toward the road surface; there is no requirement on such wings to be invertible in an analogue to tacking a sailboat.

While sailing craft having rigid "wing" sails including separately controllable elements to allow tacking to windward have been successful from the point of view of ultimate sailing performance, perhaps most notably in the successful 1988 America's Cup boat *Stars & Stripes*, such rigid wing sails are totally unsuited for the vast majority of sailboats, which require that the sails be readily removable and stowable. As a practical matter, therefore, sails for sailboats must be made of relatively flexible cloth materials, stiffened if at all by removable "battens", so as to be foldable and rollable for convenient removal and stowage. The "sailcloth" itself may be a woven polyester fabric, e.g. "Dacron", a laminated composite material comprising strands of high-modulus carbon or aramid ("Kevlar") fiber bonded between sheets of polyester film material "Mylar"), or various others. The teachings of the present invention are applicable to all types of cloth sails.

The typical "sail trimming" problem faced by the sailor in sailing to windward is in shaping his or her sail, and orienting it properly with respect to the apparent wind, so as to optimize the lift to aerodynamic drag ("L/D") ratio. Improvement in lift, or reduction of drag, both result in increased force driving the boat to windward. Correct sail trim also allows the boat to make progress to windward at a course closer to the direction of the true wind, that is, to "point higher", than possible if the trim is incorrect. Each of these improvements result in improved net velocity toward the source of the wind, normally expressed as velocity made good, or "VMG".

Achieving the correct sail trim is not simply a matter of setting one's sails in the same manner whenever sailing. Rather, the correct sail trim varies widely with wind speed, wave conditions, and the boat's heading with respect to the wind. Accordingly, modern sails are cut so as to respond to a wide variety of adjustment devices provided by the corresponding sailboats. For example, in sailing to windward, the L/D ratios of sails are commonly optimized in response to apparent wind speed by adjusting the "depth" or fullness of the sail. In general, at relatively low wind speeds, the sail is adjusted to be relatively full, increasing lift at some cost in aerodynamic drag; as the wind increases, the sail is flattened to reduce drag, adequate lift being provided by the increase in wind speed. At some wind speed, the lateral forces exerted on the hull of the boat by the sails may exceed the boat's ability to resist such forces; it then becomes necessary to reduce sail area, typically by "reefing" the sail.

It will be appreciated by those of skill in the art that VMG can be improved by providing increased lift, and/or reduced drag, particularly at low wind speeds, where lift is at a premium, preferably together with improvements in a given sail's pointing ability; each of these improvements results in increased VMG, and if provided together would provide a substantial increase. However, doing so will only be useful if the use of the sail is not otherwise interfered with; for example, one could always increase lift at a given wind speed by providing a larger sail, but this is impractical for existing boats, as larger and more expensive spars, stronger rigging and the like would be required. A larger sail will also need to be reefed earlier unless concomitant increases are made in the boat's sail-carrying ability, e.g., by addition of ballast. In any event, the rules of many racing classes improvement of the performance of racing sailboats being a principal aspect of the invention—prohibit carrying larger sails.

It would, however, be appropriate to provide improvements to the design of sails, specifically to provide sails of a given size but exhibiting improved L/D ratio and/or improved pointing ability, that could be implemented without interfering with the normal functioning of the sails, e.g., without interfering with the normal hoisting, lowering, reefing, removal, and stowage procedures. Further, it is desired that any such improvements be suitable for implementation by way of ready and inexpensive retrofit modifications to existing sails, and without requiring significant modification to the spars, rigging or hull of the boat. It is also desired that any such modifications not significantly complicate the usual sail trimming and handling procedures, such that the steps involved in carrying out routine sailing manuevers, e.g., tacking, are not complicated further.

OBJECTS OF THE INVENTION

It is therefore an object of the invention to provide a modified sail for a sailboat having an improved L/D ratio as compared to otherwise similar unmodified sails, so that additional force driving the boat to windward is provided.

It is a further object of the invention to provide a modified sail for a sailboat able to provide its optimal L/D ratio at an angle of attack with respect to the apparent wind that is less than the corresponding optimal angle of attack of an otherwise similar unmodified sail, so that the boat points closer to the apparent wind.

It is a further object of the invention to achieve the above objects of the invention in a manner such that the advantages of the invention can be obtained without significantly complicating sail handling and trimming procedures, and specifically such that the steps involved in carrying out routine sailing manuevers, e.g., tacking, are not complicated further.

It is a further object of the invention to achieve the above objects of the invention by provision of a simple modification to an existing sail that can be readily and inexpensively implemented at reasonable cost, and without requiring significant modification to the spars, rigging or hull of the boat.

SUMMARY OF THE INVENTION

According to the invention, the trailing edges of a pair of flaps of a conventional sail material (e.g., each between about two and about eight inches wide for sails of typical proportion) are attached to the trailing edge ("leech") of the sail, one on each side; the leading edges of the flaps are not fixed to the sail, but are connected to one another by short sections of line extending through holes in the sail. When the boat is tacked from one tack to the other, the leading edge of the flap on the new windward side is pulled away from the surface of the sail by the wind, so that a lip is provided on the windward side of the leech. At the same time, the lines pull the leeward flap against the main body of the sail, so that drag is not increased substantially. No control action is required to cause the flaps thus to be reconfigured upon tacking, so that ordinary sailing manuevers are not complicated by provision of the flaps according to the invention. All normal sail handling operations may be carried out without complication. Various options for controlling the effective width of the flaps in response to varying wind conditions are discussed below.

Non-quantitative experimental results to date show clearly that a sail modified to include the self-tacking leech flaps according to the invention has a L/D ratio that is substantially improved with respect to the unmodified sail; the pointing ability of the boat using the modified sail is also notably improved. The exact reasons for these results are not relevant to the patentability of the invention, and the inventor does not assert any one theory of operation. However, it appears from preliminary wind-tunnel testing that provision of a small flap on the windward side of the leech increases the thickness of the attached boundary layer on the windward side of the sail; this in turn allows the sail to operate at a reduced angle of attack, improving the boat's pointing ability. It seems further that a low-pressure zone formed behind the flap on the windward side of the leech encourages late separation of flow from the leeward side, reducing drag, and encouraging increased flow over the leeward side, increasing lift. These possibilities are discussed further below, with reference to the leading works on the subject of sailboat aerodynamics. According to the present invention, these advantages are provided in sails for sailboats that are no more complicated to use than ordinary sails, so that tacking the boat does not involve any additional control actions, and in which all normal sail-handling operations may be performed as usual.

BRIEF DESCRIPTION OF THE DRAWINGS

The invention will be better understood if reference is made to the accompanying drawings, in which.

DESCRIPTION OF THE PREFERRED EMBODIMENTS

Figures 1, 2:
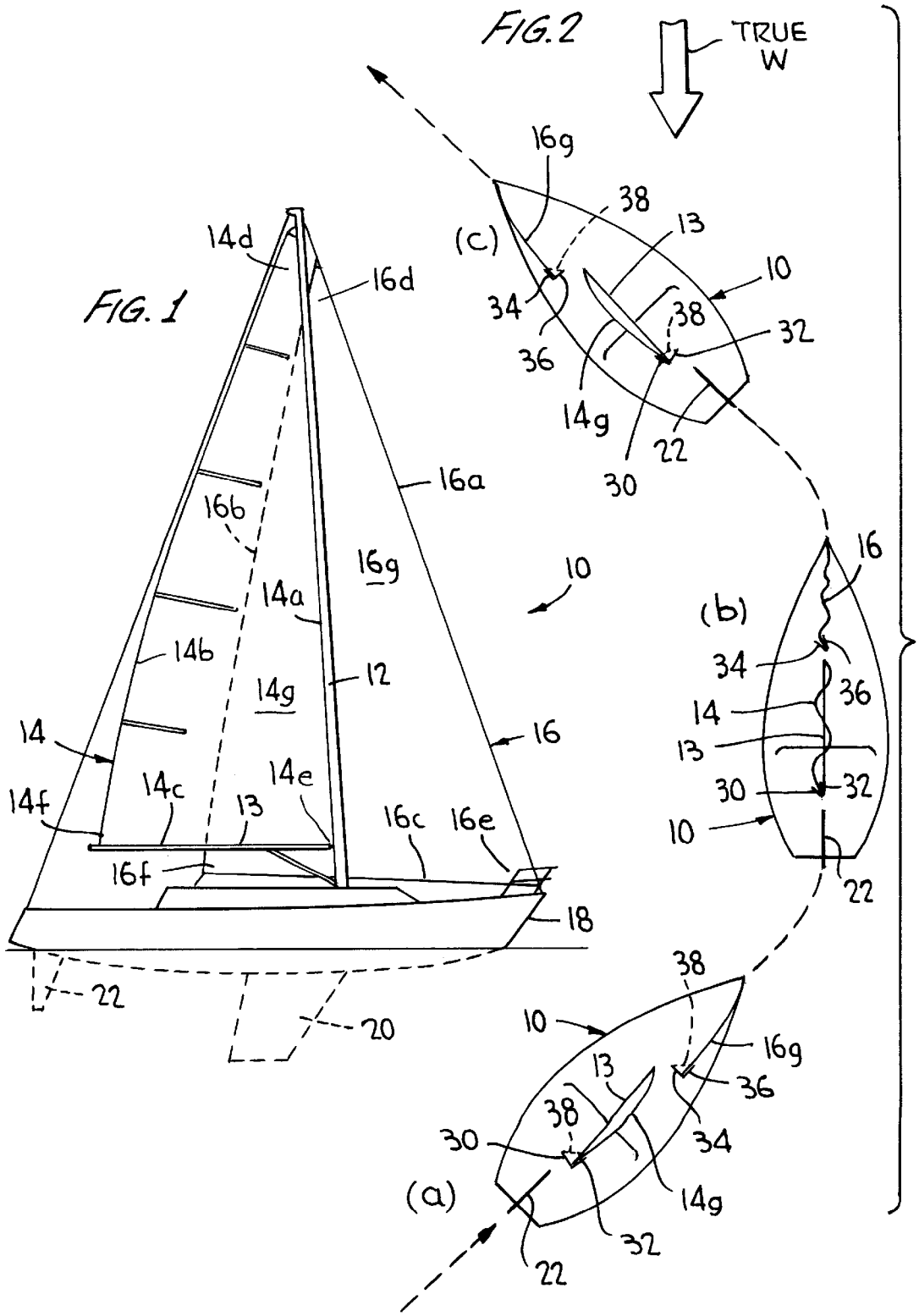
FIG. 1 shows in elevation a sketch of a sailboat having the most common rig for sailboats having more than one sail, the "Bermuda" rig, and identifies components important to understanding the invention.
FIG. 2 shows a diagram of a boat tacking to windward, as seen from above, and illustrating use of the modified sail according to the invention.

FIG. 1 shows a sketch of a sailboat 10 of the type normally referred to as a "sloop", that is, having a single mast 12 and carrying a mainsail 14 and a headsail or jib 16 when sailing to windward; other sail combinations may be used when sailing downwind. Bouyancy is provided by a hull 18; the lateral area of a ballasted keel 20 provides hydrodynamic resistance resisting lateral forces exerted on the sails by the wind, and the weight of the keel 20 provides a couple tending to stabilize the boat in the vertical position. A pivoted rudder 22 allows steering. These and other elements of the boat 10 are thoroughly discussed in the prior art, including references discussed below. The sloop rig is much the most common for sailboats over about 16 feet in length; smaller boats, commonly referred to as "dinghies", typically have a single mainsail. The improved sails of the invention are applicable to these rigs and numerous others, as discussed further below, and also to sailboats of other hull types, such as centerboard boats and multihull boats.

The same nomenclature is applied to the parts of both the mainsail 14 and the jib 16. The leading edge of both sails, 14*a* and 16*a* respectively, is referred to as the "luff"; the trailing edge, 14*b* and 16*b* respectively, as the "leech"; and the lower edge, 14*c* and 16*c* respectively, as the "foot". The foot of the mainsail is secured to a boom 13 pivoted on mast 12. The upper corner of each sail, 14*d* and 16*d* respectively, is the "head"; the forward lower corner, 14*e* and 16*e*, the "tack"; and the after lower corner, 14*f* and 16*f*, the "clew". For the purposes of the present application, the principal planar component of the mainsail 14 (essentially corresponding to an entire mainsail as in the conventional practice) is referred to as its "main membrane" 14*g*; similarly, the principal planar component of the jib 16, again essentially equivalent to a conventional jib, is referred to as the main membrane 16*g* thereof.

According to the present invention, a pair of flaps of relatively flexible material, typically conventional sailcloth, are provided on either side of the leech of one or more of the sails, that is, running between the head and clew thereof. The trailing edges of the flaps are fixed to the leech of the sail, typically by stitching passing through both flaps and the main membrane of the sail. The forward edges of the flaps are connected by a number of short cords passing through the main membrane of the sail, so that as one flap is spread away from the main membrane of the sail by the wind, the other flap is drawn toward the opposite side thereof; when the sailboat tacks, so that wind is now incident on the opposite side of the sail, the relative positions of the flaps are inverted.

This process is illustrated schematically in FIG. 2, comprising FIGS. 2(*a*)–(*c*), corresponding to the sequence of events in a typical tacking manuever. FIGS. 2(*a*)–(*c*) are sketches of a sailboat 10 from above; it will be appreciated that the "heeling" (i.e. transverse inclination) of the boat 10 under the influence of the wind is not shown, for simplicity. Thus, in FIG. 2(*a*), the boat 10 is "on the port tack", that is, the wind, from the top of FIG. 2 as indicated, passes first over the left ("port") side of the boat 10. Accordingly, the left sides of the mainsail 14 and jib 16 are "to windward", i.e., the wind is incident thereon; the right sides of the sails are thus "to leeward". In this embodiment, a first pair of flaps 30 and 32 (shown out of scale for clarity) are provided on the leech of the mainsail 14, and a second pair 34 and 36 on the leech of the jib. While on port tack, in FIG. 2(*a*), the flaps on the then-windward sides of the sails, i.e., flaps 30 and 34, are urged away from the main membranes 14*g* and 16*g* thereof, while the cords 38 pull the flaps 32 and 36 against the then-leeward surfaces of the main membranes.

When the sailor desires to tack, that is, to turn the boat so that its opposite side is to windward, the rudder is operated so that the boat first turns head to wind, as in FIG. 2(*b*); its momentum then allows the turn to be continued, so the boat 10 goes onto the "starboard tack", as shown in FIG. 2(*c*), the wind then passing over the right ("starboard") side of the boat first. As will be apparent, the right sides of the mainsail 14 and jib 16 then become the windward sides, and the left sides become the leeward. (Conventional control devices, well-known to the art, control the excursion of the sails from side to side during tacking and other manuevers; these manuevers, and the control devices, are not modified significantly according to the invention, and so are not discussed in detail here.) According to the invention, the right-side flaps 32 and 36 are then pulled away from the corresponding main membranes 14*g* and 16*g* by the wind; the left-side flaps 30 and 34 are pulled against the main membranes by cords 38.

It will thus be appreciated that according to the invention interconnected flaps are provided on either side of the leech of one or more sails of a sailboat, and moreover that as the boat tacks, so that the windward and leeward sides of the sail are alternated, the flap on the leeward side collapses and that on the windward side opens. According to an important aspect of the invention, no additional control action on the part of the sailor is required to thus reconfigure the sail upon tacking.

Figure 3:
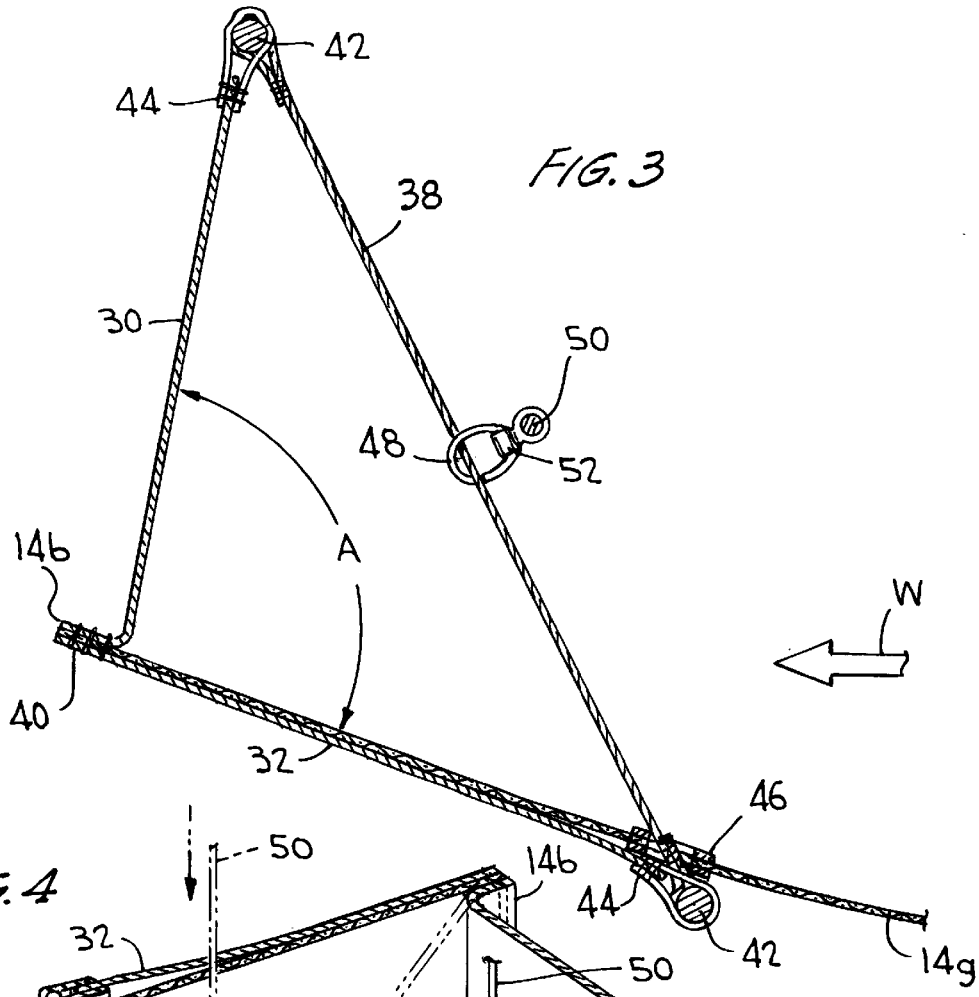
FIG. 3 shows a cross-sectional view through the leech of a sail having been modified according to the invention.

FIG. 3 shows an enlarged cross-sectional view looking downwardly through the leech portion of the main membrane 14*g* of the mainsail 14, illustrating the flaps 30 and 32. An essentially similar view would be seen as to any other sail to which the modifications according to the invention were applied. The location of wind symbol W with respect to the sail indicates that FIG. 3 corresponds to the port tack situation of FIG. 2(*a*), so that the left surface of main membrane 14*g* in the illustration is to windward. Accordingly, wind from forward of the sail (i.e., from right to left in FIG. 3) tends to pull the left-side, or windward, flap 30 away from main membrane 14*g*. Control cords 38 are provided at intervals along the length of flaps 30 and 32, extend through apertures in the main membrane 14*g*, and are secured to the opposed leading edges of flaps 30 and 32. Accordingly, as one flap is opened by the wind, the other is drawn closed by control cords 38. For example, in the port tack configuration shown, the right-side leeward flap 32 is drawn towards and thus lies against the leeward surface of main membrane 14*g*. When the boat is tacked, so that the right side becomes the windward side, the wind pulls the right-side flap 32 away from the main membrane 14*g*, while cords 38 then pull the left-side leeward flap toward the main membrane 14*g*. Thus, the relative configuration of the flaps with respect to the main membrane is automatically reversed during tacking, without necessitating any additional control action on the part of the sailor.

The flaps are designed so that on either tack the leeward flap conforms closely to the leeward surface of membrane 14*g*, so as to impede the smooth flow of air off the leeward side of the leech as little as possible, while the windward flap provides substantial resistance to the flow of air off the windward side of the leech. The significance of these very different functional characteristics of the leeward and windward flaps is discussed below.

To further explain the structure shown in FIG. 3, the flaps 30 and 32 may be made of sailcloth similar to that used for the main membrane 14*g*, or of a material of generally comparable characteristics. (The selection of a particular sailcloth for a particular application is relatively complex; various reference books devote substantial space to the subject. See Whidden, *The Art and Science of Sails*, discussed below. In general, flaps 30 and 32 can be made of any sailcloth material.) The typical width of the flaps is between about two and about eight inches, depending on the size of the sail; however, it will be understood by those of skill in the art that the aerodynamic effect of the flaps is a function of wind speed, not sail size per se. Accordingly, the flaps for smaller sails will be proportionally wider than those for larger sails. The width of the flaps may also vary along the length of the leech, corresponding to variation in the chord, that is, the horizontal dimension, of the sail. Successful tests were carried out with flaps four inches wide on a sail having a foot length of 72 inches, so that the width of the flap was approximately 6% of the chord at the foot. It is envisioned that the width of the flaps may thus be between about 1 and about 10% of the chord at any point along the leech.

The trailing edges of flaps 30 and 32 can be secured to the main membrane by being stitched to the leech edge 14*b* thereof, as indicated at 40. The leading edges of flaps 30 and 32 may be stiffened and prevented from fraying by being wrapped around flexible members 42, e.g., lengths of small-diameter braided line as conventionally used for various rigging purposes aboard sailboats, and stitched as indicated at 44 to confine the members 42. As indicated in FIG. 3, the control cords 38 may be conveniently secured to the leading edges of flaps 30 and 32 by being passed around and secured to members 42. Control cords 38 may also be of small-diameter braided line; on smaller boats, heavy nylon fishing line may be used. Grommets 46 may be provided where control cords 38 pass through main membrane 14*g*, to limit wear.

As noted above, and as will be apparent, sailboats must be capable of safe operation in a wide variety of weather conditions, specifically in winds of significantly varying strength. Modern sailboats provide varyingly sophisticated sail controls so that the sailor can shape the sails—principally, to adjust the L/D ratio—according to the wind speed; for example, a sail shaped to extract maximum lift from a light breeze of six knots is likely to overpower the boat in a stiff breeze of 20 knots. As noted above, the flaps provided according to the invention provide additional lift, as is highly desirable in light air; however, when the wind picks up, the additional lift and resistance to flow off the windward side of the leech provided by the flaps according to the invention may be undesirable. Of course, according to an important aspect of the invention, ordinary sail-handling techniques are not interfered with by incorporation of the flaps of the invention, so that the improved sail according to the invention can still be reefed (i.e., have its overall area reduced); however, in certain circumstances, it may additionally be desirable to reduce the effect of the flaps.

Figure 4:
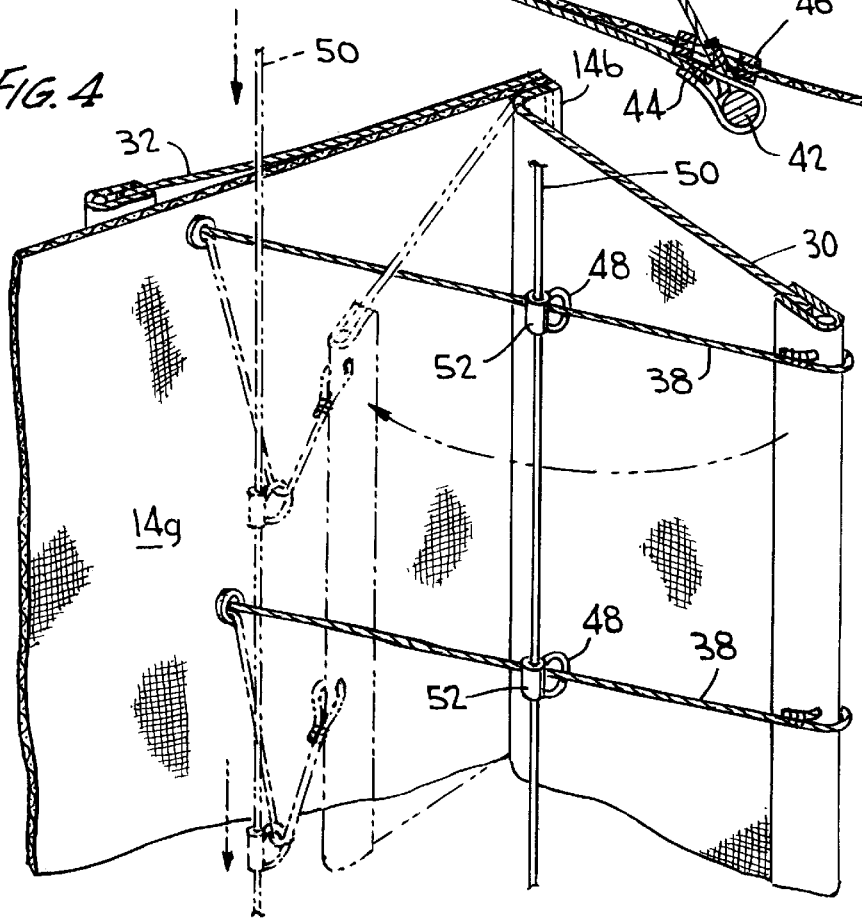
FIG. 4 shows a perspective view of a portion of the leech of a sail having been modified according to the invention, and illustrating a further improvement.
Figure 5A:
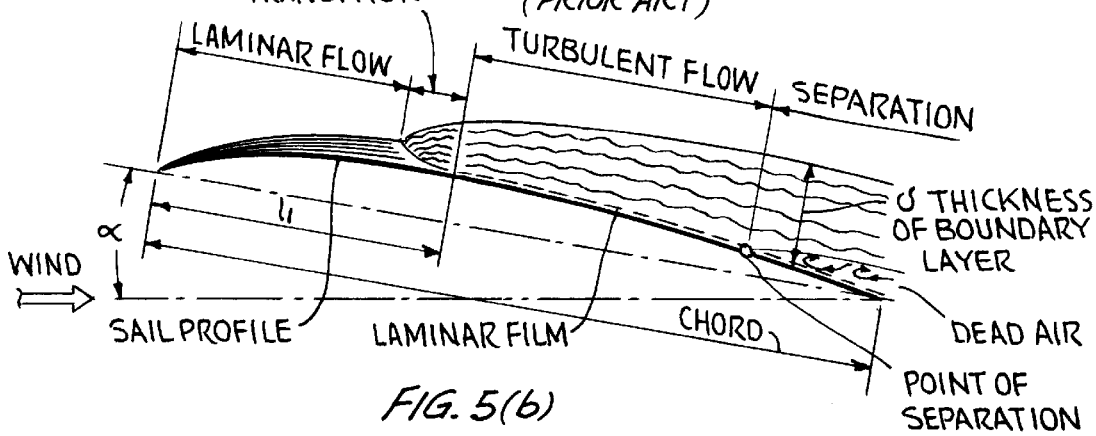
FIG. 5(a) (PRIOR ART)
FIG. 5, comprising FIGS. 5(*a*)–(*d*), is a series of diagrams illustrating the theory by which the invention provides improved sailboat performance.
Figure 5B:
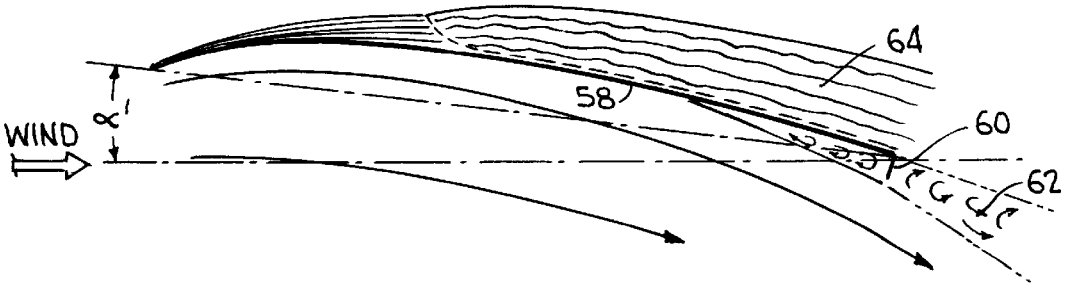
Figure 5C:
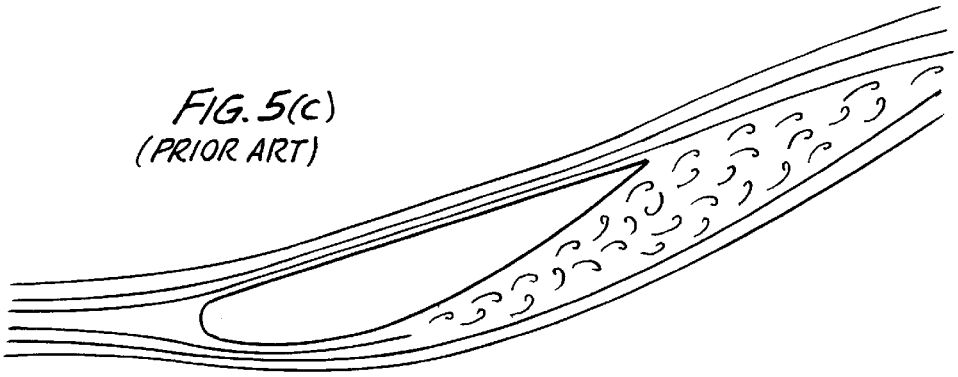
FIG. 5(c) (PRIOR ART)
Figure 5D:
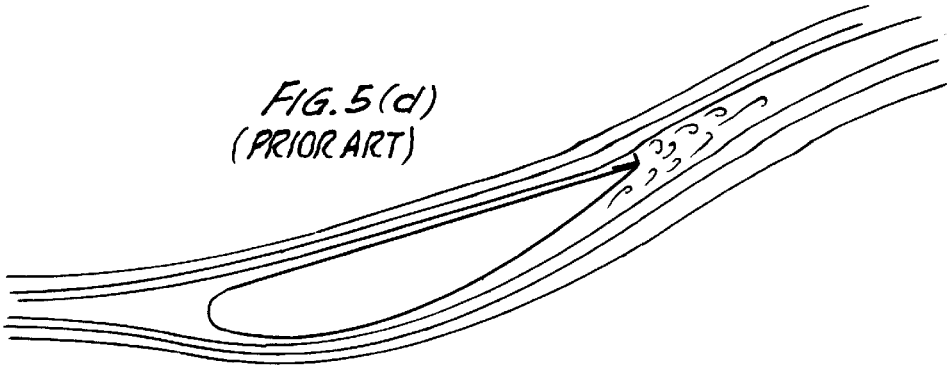
FIG. 5(d) (PRIOR ART)

The maximum effect provided by flaps is realized when angle A between the windward flap and the main membrane (see FIG. 3), is substantially 90°, that is, when substantially the full width of the windward flap impedes the flow of air off the windward side of the sail. The flaps can be made self-adjusting to a degree by making the control cords 38 of an elastic material, so that as the wind speed increases, the angle A is urged past 90°, reducing the total force. However, this may distort the shape of main membrane 14*g*. Another possibility, illustrated in FIGS. 3 and 4, is to dispose a ring 48 over each control cord 38; a flap furling line 50, running generally parallel to the leech 14*b*, is secured, e.g., by crimped members 52, to each ring 48. Thus, in order to reduce the effect of flaps 30 and 32, flap furling line 50 is pulled downwardly by the sailor, effectively reducing the length of the control cords 38 and limiting the maximum opening of flaps 30 and 32, as indicated in phantom in FIG. 4. Flap furling line 50 can then be cleated at the boom 13 (FIG. 1), if the sail in question is mainsail 14, or otherwise secured. Other methods for reducing the effect of flaps 30 and 32 will occur to those of skill in the art and are within the scope of the invention.

As mentioned above, the self-tacking flaps provided for sailboat sails according to the invention provide a clearly beneficial effect; it is not necessary that the inventor specify a theoretical reason for this result. Nonetheless, it is believed useful to provide an explanation, with the understanding that the invention is not to be limited thereby. FIG. 5(*a*) shows a sketch (drawn from FIG. 80 of Marchaj, *Sail Performance* (1996)) of air flow over the leeward ("suction") side of a conventional sail, while FIG. 5(*b*) shows a similar sketch with respect to a sail having a flap on the windward side of the leech according to the invention.

FIG. 5(*a*) also explains certain terminology useful in defining the invention. Thus, in FIG. 5(*a*), a sail having the cross-sectional profile shown is disposed at an "angle of attack" $\alpha$ with respect to the apparent wind, and the overall linear dimension of the sail in a plane parallel to the waterline at any given point therealong is referred to as the "chord". As illustrated, air flowing over the leeward side of the sail flows for a time in smooth, low-drag, "laminar" fashion; after a short transition section, most of the flow becomes turbulent, although a film exhibiting laminar flow persists until a point of separation, at which all flow is separated from the surface, leaving a region of dead air. Marchaj (pages 40–111 of which are incorporated by reference) makes it clear that the aerodynamic drag, contributing in an undesirable way to the L/D ratio of the sail, is largely due to this separation. See also Whidden, "Lift and Drag" and "Frictional Drag", pages 102–110 in *The Art and Science of Sails*, supra, pages 72–110 of which are incorporated herein by reference: "[C]reating lift is the easy part; the difficult part is minimizing drag and preventing separation of the airflow." Whidden, page 107.

FIG. 5(*b*) shows a sketch similar to FIG. 5(*a*), illustrating flow off the leeward side of a sail 58 having a flap 60 extending into the flow off the windward side of the leech added according to the invention. As indicated, the flap 60 disrupts the flow off the windward side of the leech; this creates a low-pressure area 62 behind the flap 60. Low-pressure area 62 pulls the turbulent air 64 flowing off the leeward side of the leech to windward, that is, toward the extended centerline of the main membrane of sail 58, delaying or preventing separation of the flow from the leeward surface.

Although quantitative figures are not presently available, it is clear that aerodynamic drag is significantly reduced by provision of flaps on the windward side of the leech according to the invention. The inventor's experiments also demonstrate that the angle of attack $\alpha'$ of the modified sail is less than the corresponding angle $\alpha$ of the unmodified sail, meaning that the boat can point closer to the apparent wind. As noted above, both reduction in drag and reduction in the angle of attack lead directly to improved VMG, that is, improved speed toward the source of the wind. Moreover, because according to the invention the sail is automatically reconfigured upon tacking, so that a flap is provided on the windward side of the leech on either tack, the benefits of reduced drag are available on both tacks without further complication of the sail trimming process. Further, because the control cords pull the flap not in use against the main membrane, this is accomplished without substantially increasing drag on the leeward side.

The inventor's understanding that the flap on the windward side of the leech can reduce drag by providing a low-pressure zone, and that this allows a reduction in the angle of attack $\alpha$, is supported by Smith, *Engineer to Win* (1984), at page 241. FIG. 222 of Smith is reproduced as FIGS. 5(*c*) and (*d*); these FIGS. depict a wing for the front of a race car designed to produce "downforce", that is, lift directed downwardly. Airflow is from left to right. In FIG. 5(*c*), the trailing edge of the wing ends at a simple apex; in FIG. 5(*d*), a narrow "Gurney flap" is added on the upper side of the trailing edge, corresponding to the windward side of the leech according to the invention. Smith's caption is "'Gurney' added to upper surface of wing trailing edge to delay separation". As stated by Smith, "The basic problem with the front wing is that ground effects shearing forces are very liable to cause separation of flow on the undersurface of the wing at relatively low angles of attack . . . The next best thing [after increasing the wing's effective span] is to install a small (3/16") Gurney on the upper surface at the rear of your current wings. As shown by [FIG. 5(*d*)], this will create a low pressure area and encourage the flow on the lower surface to remain attached. The cost in drag will be negligible and you will be able to generate the same download at a lesser angle of attack."

Figures 6A, 6B, 7A, 7B, 7C, 7D:
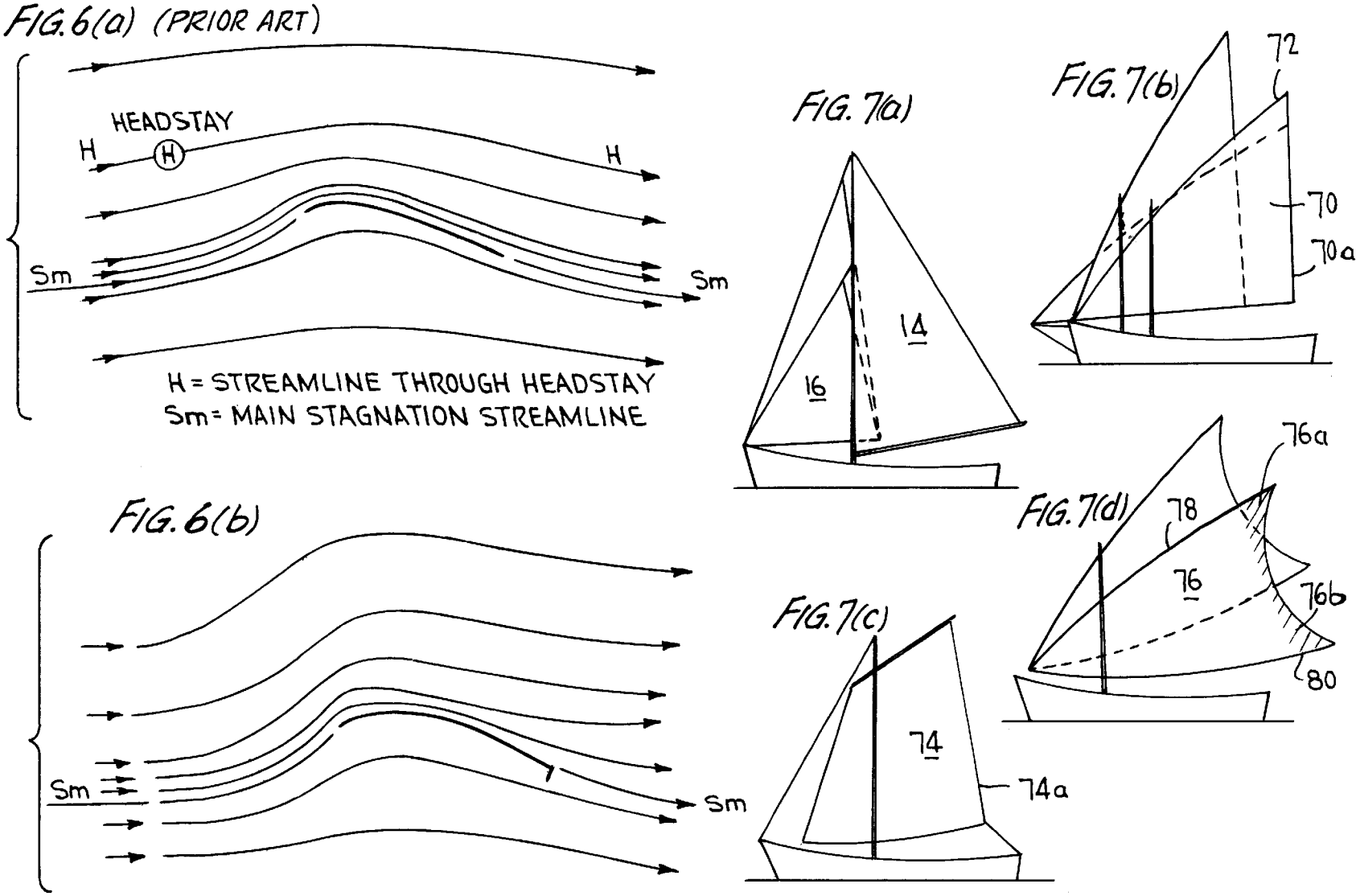
FIG. 6(a) (PRIOR ART)
FIG. 6, comprising FIGS. 6(*a*)–(*b*), includes two further diagrams illustrating the theory by which the invention provides improved sailboat performance.
FIG. 7, comprising FIGS. 7(*a*)–(*d*), shows sketches of various additional sailboat rigs to which the invention may usefully be applied.

It also appears that provision of a flap on the windward side of the leech of a sailboat sail may directly increase lift by causing an increase in the amount of "upwash" air flowing over the leeward surface. Whidden, supra, provides a good explanation of this aspect of the generation of lift by a sail. FIG. 6(*a*), corresponding to Whidden's FIG. 5.16, shows the streamlines of flow around a mainsail (without a mast); FIG. 6(*b*) shows a similar diagram of the same sail provided with a lip on the windward side of the leech according to the invention.

As explained in detail by Whidden, the lift provided by a properly-trimmed sail can be understood as provided by an "upwash" of air occuring in front of the leading edge of the sail; the upwash is driven by circulation around the sail, necessitated in order that the "Kutta condition" can be satisfied. The upwash is shown in FIG. 6(*a*) by the streamlines bending upwardly to the left of the sail. Air to leeward of the stagnation streamline $S_m$ flows to leeward, and air to windward of $S_m$ to windward. The relative closeness of the streamlines above the sail, that is, on the leeward side, as compared to their wider spacing on the lower windward side, indicates that the wind velocity on the leeward side is greater than on the windward side; according to Bernoulli's theory, there is accordingly lower pressure on the leeward side, so that the sail is urged in that direction, providing lift.

As shown in FIG. 6(*b*), the sail modified according to the invention so as to have a lip on the windward side of the leech provides additional upwash, so that the difference in pressure is intensified and the lift increased. Effectively, the stagnation streamline $S_m$ is moved to windward, so that more air flows to leeward.

As noted, however, the inventor does not assert that these explanations for the positive beneficial effects provided by the invention are necessarily complete.

As noted above, while the vast majority of sailboats are rigged as single-sail dinghies, or as Bermudan sloops as in FIG. 1, the improvements in sails according to the invention have applicability to sailboats of other rigs and of various hull designs, including multihulled craft. FIG. 7, which is drawn from Marchaj's FIG. 133, shows several sailboat rigs as to which the invention may be applied. FIG. 7(*a*) illustrates the Bermudan rig; as discussed, leech flaps according to the invention may usefully provided on the leeches of both the mainsail 14 and jib 16. FIG. 7(*b*) shows the lateen rig, having a single sail 70 hung from an angled yard 72 (a lower yard sometimes also being provided), with several possible sail shapes illustrated. The flaps according to the invention could usefully be provided on the leech 70*a* of this sail. FIG. 7(*c*) shows the dipping lug rig, having a single sail 74, which is effectively a truncated version of the triangular sail of the sloop rig; again, the flaps according to the invention could usefully be provided on the leech 74*a* of this sail. Well-known gaff-headed sails are similarly truncated triangular sails, and would similarly be improved by provision of the flaps according to the invention on the trailing edges or leeches thereof.

It will be appreciated that in each of these rigs, the mainsails have clearly defined leading and trailing edges, that is, luffs and leeches respectively, which are both relatively perpendicular to the direction of movement of air over the sail; the flaps according to the invention are applied to the trailing edges or leeches thereof. Similarly, the jibs of conventional sloops have clearly-defined leading and trailing edges, both relatively perpendicular to the direction of movement of air over the sail and also referred to as luffs and leeches respectively; again, the flaps according to the invention may usefully be applied to the trailing edges or leeches of such jibs.

FIG. 7(*d*) shows the "crab-claw" rig, which is significantly different in its method of generation of lift. In the crab-claw rig, a sail 76 (illustrated trimmed to two sweepback angles) having pronounced "swallowtail" extensions (shown shaded, at 76*a* and 76*b*) is supported between two yards 78 and 80. As discussed above, the triangular and truncated triangular mainsails of the conventional rigs discussed above have leading edges or luff s, and trailing edges or leeches, both substantially perpendicular to the direction of flow of air over the sail. By comparison, the crab-claw sail has no leading edge, per se, but "divides" the wind between its windward and leeward surfaces, thus generating lift, beginning at the point of intersection of its yards 78 and 80. Nor does the after edge of the crab-claw correspond functionally to the leech of the sails of the conventional rigs discussed above.

Marchaj, supra, discusses this unusual rig in detail at pages 152–176; repeating that discussion is beyond the scope of this application. Suffice it to say that the "vortex lift" mechanism of lift generation asserted by Marchaj to be exhibited by the crab claw rig is different than the "potential" lift mechanism of the other rigs discussed above. In essence, differential flow of air off the windward and leeward surfaces of the crab claw sail at both its opposed edges, adjacent the yards 78 and 80, is important in generating lift. That is, in use of the crab-claw rig, the opposed edges are both in effect trailing edges, analogous to the leeches of conventional vertically-oriented sails, such as the conventional triangular mainsails of the sloop rig of FIGS. 1 and 7(*a*), or the truncated triangular mainsails of the dipping lug or gaff-headed rigs discussed above, or the jibs of either. Accordingly, it appears possible that provision of self-tacking flaps according to the invention on either side of both of the opposed edges of the crab claw sail, that is, adjacent both yards 78 and 80, would be useful in increasing lift. Therefore, it should be understood that the invention is not limited to providing self-tacking flaps only on the leeches, i.e., trailing edges, of sails of the types in common use today.

While the invention has been largely discussed in terms of improvements in upwind sailing performance, it will be understood that sails having self-tacking flaps according to the invention may be used on other points of sail as well.

While a preferred embodiment of the invention has been discussed in detail, and various alternatives thereon disclosed, the invention is not to be limited thereby.

What is claimed is:

1. Leech flaps for being applied to the leech of a conventional sail of a sailboat, comprising a pair of flaps of sailcloth having leading and trailing edges, the trailing edges of the flaps adapted to be secured to either side of the trailing edge of the leech of the sail, and a plurality of control cords adapted to be attached to the leading edges of said flaps and pass through apertures in said sail, wherein the width of said flaps is between about 1% and about 10% of the chord of said sail.

2. The leech flaps of claim 1, further comprising means for limiting the degree to which the leading edge of the flap on the windward side of the sail may be pulled away from the leech by the wind.

3. The leech flaps of claim 1, wherein said leading edges of said flaps comprise flexible members confined within folded-over portions of the fabric of the sailcloth of said flaps, said control cords being attached to said flexible members.

4. A sail for a sailboat, said sail having a leading edge or luff, a trailing edge or leech, and a pair of leech flaps, said pair of leech flaps comprising strips of sailcloth having leading and trailing edges, the trailing edges of the flaps being secured to either side of the trailing edge of the leech of the sail, and a plurality of control cords attached to the leading edges of said flaps and passing through apertures in said sail, wherein the width of said flaps is between about 1% and about 10% of the chord of said sail.

5. The sail of claim 4, further comprising means for limiting the degree to which the leading edge of the flap on the windward side of the sail may be pulled away from the leech by the wind.

6. The sail of claim 4, wherein said leading edges of said flaps comprise flexible members confined within folded-over portions of the fabric of the sailcloth of said flaps, said control cords being attached to said flexible members.

7. An improved sail for a sailboat, said sailboat comprising sail support and control means such that in use either side of a main membrane of said sail may be controllably exposed to wind, said improved sail having a pair of flaps disposed on either side of a trailing edge of said sail off which trailing edge wind flows in use, said flaps each having a leading edge and a trailing edge, the trailing edges of said flaps being secured to the trailing edge of said main membrane of said sail, and the leading edges of said flaps being joined by control cords passing through the main membrane of said sail, whereby as the flap on a windward side of said main membrane is pulled away from the main membrane by the wind, the flap on the leeward side of the main membrane is drawn toward the main membrane, such that the flap on the windward side substantially impedes flow of air off the windward side of the trailing edge of the sail, and the flap on the leeward side only minimally impedes flow of air off the leeward side of the trailing edge of the sail.

8. The improved sail of claim 7, wherein the width of said flaps is between about 1% and about 10% of the chord of said sail.

9. The improved sail of claim 7, wherein said sail is substantially triangular in form, having a leading edge and a single trailing edge both substantially perpendicular to the direction of flow of air over said sail, and said flaps are applied to said trailing edge.

10. The improved sail of claim 7, wherein said sail is of "crab-claw" form, having two trailing edges off which air flows in normal use of said sail, and said flaps are applied to both of said trailing edges.

11. The improved sail of claim 7, further comprising means for limiting the degree to which the leading edge of the flap on the windward side of the sail may be pulled away from the main membrane by the wind.

* * * * *